US008342231B2

(12) United States Patent
Kawaguchi et al.

(10) Patent No.: US 8,342,231 B2
(45) Date of Patent: Jan. 1, 2013

(54) CAST STRIP WITHDRAWING APPARATUS FOR CONTINUOUS CASTING FACILITY

(75) Inventors: Hiroshi Kawaguchi, Takasago (JP); Fumiki Asano, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/296,597

(22) Filed: Nov. 15, 2011

(65) Prior Publication Data

US 2012/0152486 A1 Jun. 21, 2012

(30) Foreign Application Priority Data

Dec. 16, 2010 (JP) ..... 2010-280688

(51) Int. Cl.
*B22D 11/20* (2006.01)

(52) U.S. Cl. ..... 164/413; 164/442

(58) Field of Classification Search ..... 164/413, 164/425, 426, 441, 442, 454, 484
See application file for complete search history.

(56) References Cited

U.S. PATENT DOCUMENTS

| | | | | |
|---|---|---|---|---|
| 3,983,631 | A * | 10/1976 | Dutzler | 33/657 |
| 4,598,761 | A * | 7/1986 | Ishihara et al. | 164/263 |
| 7,806,164 | B2 * | 10/2010 | Morales et al. | 164/454 |

FOREIGN PATENT DOCUMENTS

| | | |
|---|---|---|
| JP | 59-29350 | 7/1984 |
| JP | 61-28425 | 6/1986 |
| JP | 2-32062 | 7/1990 |

* cited by examiner

*Primary Examiner* — Kevin P Kerns
(74) *Attorney, Agent, or Firm* — Oblon, Spivak, McClelland, Maier & Neustadt, L.L.P.

(57) ABSTRACT

A cast strip withdrawing apparatus includes a plurality of pairs of rolls, and retains and withdraws a dummy bar via a fixed-side roll and pressure-side roll, which face each other, of each of these pairs of rolls. Each of the pressure-side rolls includes a fluid pressure cylinder imparting a dummy bar retaining pressure. A source pressure side fluid line supplying fluid pressure to these fluid pressure cylinders includes: a first pressure-reduction unit, a pressure drop detection unit, a line isolating unit installed on a source pressure side of the pressure drop detection unit, and a bypass unit.

7 Claims, 12 Drawing Sheets

CAST STRIP WITHDRAWING APPARATUS FOR CONTINUOUS CASTING FACILITY

BACKGROUND OF THE INVENTION

1. Field of the Invention

The present invention relates to a cast strip withdrawing apparatus for a continuous casting facility. More specifically, the present invention relates to a cast strip withdrawing apparatus for a continuous casting facility that does not allow an excessive pressing force to act on a cast strip or dummy bar during normal operation, and does not allow a cast strip or dummy bar to fall when there is hydraulic trouble.

2. Description of the Related Art

Conventionally, in continuous casting facilities that continuously cast molten steel supplied from a ladle, a plurality of roll segments is arranged below a mold along a withdrawing direction (casting direction) of cast strips, and a cast strip guide device is configured by this plurality of roll segments. Every roll segment is made to include a support roll that supports the cast strip thus cast, while between these roll segments, a plurality of cast strip withdrawing apparatuses equipped with a drive roll for withdrawing the cast strip along the withdrawing direction is installed.

Furthermore, it is configured so that the cast strip thus cast is withdrawn by the cast strip withdrawing apparatuses while being supported by the support rolls. However, at the initial stage of operation of a continuous casting facility, ahead of the cast strip, a dummy bar is withdrawn by the cast strip withdrawing apparatus while being supported by the support rolls.

Therefore, the cast strip withdrawing apparatus of the continuous casting facility related to the conventional example will first be explained while referring to the following appended FIGS. 9 to 12 as well. FIGS. 9 and 10 are a plan view and front view showing a cast strip withdrawing apparatus of the continuous casting facility according to conventional example 1, respectively. FIG. 11 is a hydraulic circuit illustrative drawing that includes an emergency hydraulic valve of a cast strip anti-drop device in a continuous casting machine according to conventional example 2. FIG. 12 is a schematic diagram showing an example of a cast strip and dummy bar anti-drop hydraulic circuit for a continuous casting machine according to conventional example 3.

Therefore, the cast strip withdrawing apparatus of the continuous casting facility according to conventional example 1 will first be explained hereinafter while referring to the appended FIGS. 9 and 10. Normally, plural cast strip withdrawing apparatuses 33 are provided at predetermined intervals in the vertical direction in a vertical continuous casting facility. In each cast strip withdrawing apparatus 33, two pairs of fixed-side rolls 37 are mounted to each frame 36, pressure-side rolls 38 are mounted to be able to advance and retract with respect to the fixed-side rolls 37, and a cast strip 32 is held between both the rolls 37 and 38 by pressing the pressure-side rolls 38 toward the fixed-side rolls 37 by way of a hydraulic cylinder 39. Then, both the rolls 37 and 38 are rotationally driven by a drive motor 48 via worm reduction devices 41 and 42, universal spindles 46 and 46, and a reduction mechanism 47, whereby the cast strip 32 held between both the rolls 37 and 38 is withdrawn (refer to Japanese Examined Patent Application Publication No. H2-32062).

Here, in order to facilitate understanding, among the cast strip withdrawing apparatuses 33, a cast strip withdrawing apparatus 33 disposed at the upstream most side is defined as an upstream-most side withdrawing apparatus, and a cast strip withdrawing apparatus 33 after this withdrawing apparatus is defined as a downstream-side withdrawing apparatus, and although their drawings are omitted, the names and symbols will be explained distinctly.

Prior to the start of casting, the dummy bar is first retained by the upstream-most side withdrawing apparatus; whereas, when casting is started, until the dummy bar is handed over from the upstream-most side withdrawing apparatus to the downstream-side withdrawing apparatus, the dummy bar and the cast strip 32 following this are retained by the upstream-most side withdrawing apparatus. During this time, there is no means for supporting the dummy bar and cast strip 32 other than the upstream-most side withdrawing apparatus.

There is similarly no means for supporting the dummy bar and cast strip 32 other than the downstream side withdrawing apparatus, after the dummy bar has been handed over to the downstream side withdrawing apparatus. A method increasing the retaining force by clamping the cast strip 32 by way of the upstream-most side withdrawing apparatus in addition to the downstream side withdrawing apparatus clamping the dummy bar can be considered; however, since the thickness of the solidified shell of the cast strip 32 on the upstream side is thin, clamping the cast strip 32 with an excessive pressing force by the upstream-most side withdrawing apparatus is not preferable from the viewpoint of the quality of the cast strip 32. Therefore, it is preferable to support the dummy bar by way of the downstream side withdrawing apparatus until the dummy bar is handed over to a cast strip withdrawing apparatus on a further downstream side of the downstream side withdrawing apparatus.

As can be understood from FIGS. 9 and 10, similarly to the cast strip 32, the dummy bar, which is not illustrated therein, is retained by the friction force generated at the contact surface between the pressure-side roll 38 and the dummy bar, and the contact surface between the fixed-side roll 37 and the dummy bar. This friction force is proportional to the pressing force of the hydraulic cylinder 39. The friction force (i.e. retaining force) is obtained by multiplying the hydraulic cylinder pressing force by the coefficient of friction of the contact surfaces between both the rolls 37 and 38 and the dummy bar.

If the retaining force is insufficient, the dummy bar falls. Especially in such a vertical continuous casting facility according to conventional example 1, the falling distance is long as tens of meters, and the dummy bar vertically falls differently from fall along a slope in a curved continuous casting facility. As a result, the fall energy becomes extremely large, and the falling trouble of the cast strip 32 and dummy bar is fatal damage accompanying considerable equipment damage.

Furthermore, in bloom continuous casting facilities and slab continuous casting facilities in which the cast strip cross-section is large, the weight of the cast strip 32 and dummy bar itself is also great, and the falling incidence seriously damages the facility and foundation following below the cast strip withdrawing apparatus 33. Thus, the retaining force is preferably set to be large to allow for a margin, and it is required that a predetermined retaining force is maintained even if a rupture in a hydraulic hose in the hydraulic circuit or an oil leak from the plumbing arises.

On the other hand, contrary to the cast strip 32, the dummy bar is formed by machining, and thus the surface thereof is flat and smooth, and the coefficient of friction is low. While hot, the coefficient of friction between the cast strip 32 and both of the rolls 37 and 38 is on the order of 0.2 to 0.3; whereas, the coefficient of friction between the dummy bar and both of the rolls 37 and 38 is merely on the order of 0.1 to 0.15. In addition, the lubricant supplied to the bearings supporting both of these rolls 37 and 38, and the bearings supporting the support rolls of the roll segment having several support rolls adheres to the surface of the rolls 37 and 38 and the surface of the dummy bar; therefore, this coefficient of friction tends to be further lowered. Therefore, in order to reliably retain the dummy bar and the cast strip 32 following this, it is necessary to either sufficiently raise the pressing force of the hydraulic cylinder 39, or increase the number of drive rolls.

If the pressing force of the hydraulic cylinder 39 is increased, the retaining force can be raised. However, the surface pressure of the contact surfaces between the dummy bar and both of the rolls 37 and 38 becomes larger with a higher margin in the retaining force. As a result, permanent strain will occur in the dummy bar surface and the surface of both rolls 37 and 38, which will harm the life span of these. Notably, any of the rolls 37 and 38 will result in breaking from the repeated bending stress occurring on the rolls 37 and 38.

In order to raise the pressing force of the hydraulic cylinder 39, the pressure of the hydraulic oil may be raised. However, a pressure of 210 MPa is the practical limit. In order to further raise the hydraulic cylinder pressing force, increasing the diameter of the hydraulic cylinder cannot be avoided. If this is done, the hydraulic cylinder 39 will increase in size and will not be able to be housed in the cast strip withdrawing apparatus 33. In order to avoid this shortcoming, the number of both the rolls 37 and 38 may be increased; however, since the drive-train as well as the hydraulic system will increase, the cast strip withdrawing apparatus 33 itself will become larger scale.

The upstream-most side cast strip withdrawing apparatus and downstream side cast strip withdrawing apparatus are configured by two pairs of fixed-side rolls 37 and pressure-side rolls 38, respectively; however, the trouble of not being able to maintain the pressing force of the hydraulic cylinder 39 may occur from a rupture of a hydraulic hose of the hydraulic cylinder 39 or leakage of the plumbing, for example. Since the two pairs of pressure-side rolls 38 and 38 are configured by a common hydraulic system, the retaining force of both of the two pairs of pressure-side rolls 38 and 38 will become zero due to the occurrence of a rupture or leakage at one point. And the dummy bar and cast strip 32 following this will fall.

In order to solve this, if an individual hydraulic system is configured for each pair of pressure-side rolls 38 and 38, the pair of pressure-side rolls 38 and 38 are not affected by other hydraulic systems. However, since the retaining force will be halved in this case as well, the dummy bar and cast strip 32 following this will fall. In addition, configuring individual hydraulic systems for each pair of the pressure-side rolls 38 and 38 is not practical from a cost standpoint. In order to solve this, a method routinely using either hydraulic cylinder 39 and 39 of the pressure-side rolls 38 and 38 with its pressing force set to twice that required can be considered; however, since the surface pressure of the contact surfaces between the dummy bar and both rolls 37 and 38 is normally large, permanent strain is produced in the dummy bar surface and the surface of both rolls 37 and 38, and thus the life span thereof is harmed. Since large bending stress repeatedly acts on the pressure-side rolls 38 and 38, there is also risk of fatigue breaking.

Next, a cast strip anti-drop device for a continuous casting facility according to conventional example 2 will be explained hereinafter while referring to the appended FIG. 11. This cast strip anti-drop apparatus includes an emergency valve unit 58 that, under abnormal situation, ensures, by way of an emergency hydraulic circuit 56, high pressure for the oil pressure of a normal hydraulic valve unit 57 of a hydraulic cylinder 54B of a pinch roll 53B and aims to prevent falling of a cast strip 51 (refer to Japanese Examined Patent Application Publication No. S59 (1984)-29350).

However, since the oil pressure of a plurality of hydraulic cylinders (54A to 54F) is secured by the one emergency valve unit 58, if one hydraulic cylinder system ruptures or leaks, the other hydraulic cylinder systems will also experience a pressure drop at the same time, and thus the anti-drop function will not operate. For example, if the system of the hydraulic cylinder 54B ruptures, the pressure in the hydraulic lines connected to the hydraulic cylinders 54A, 54C, . . . 54F will also steeply drop due to the sudden leakage. Although it is effective for a leak on the order that is covered by the volume of an accumulator 59, or the securing of a pressure drop due to an internal leak of the hydraulic system during an electrical power failure, it is ineffective in the rupture of a hydraulic hose or a large leakage incidence.

In addition, according to a cast strip and dummy bar anti-drop hydraulic circuit for a continuous casting machine according to conventional example 3, when the hydraulic system of a pressing cylinder 66 that presses a pinch roll 63 to the dummy bar 64 ruptures, as shown in FIG. 12, the influence of a pressure drop on another hydraulic actuator group 67 can be prevented by isolating an electromagnetic isolation valve 68, (refer to Japanese Examined Patent Application Publication No. S61 (1986)-28425).

However, when a hydraulic system in the hydraulic actuator group 67 ruptures, the influence of the pressure drop on hydraulic actuators on an upstream side thereof cannot be prevented. In other words, this conventional example 3 is effective in preventing a steep pressure drop due to a rupture in the hydraulic system of the hydraulic cylinder 66, but is ineffective in a rupture in a hydraulic system other than the system of the hydraulic cylinder 66. In addition, according to FIG. 12, the two pressing cylinders 66 and 66 branch and are connected to one hydraulic line leading to and from the hydraulic actuator group 67; therefore, if the hydraulic line of one pressing cylinder 66 is ruptured, the hydraulic line of the other pressing cylinder 66 will also experience a sudden pressure drop at the same time, and the dummy bar 64 will suddenly fall.

SUMMARY OF THE INVENTION

The present invention has been made in order to solve various problems such as those explained in the aforementioned RELATED ART. An object thereof is to provide a cast strip withdrawing apparatus for a continuous casting facility that does not allow a cast strip or dummy bar to fall during hydraulic trouble, without increasing the number of rolls or roll driving systems and hydraulic circuits, and without an excessive pressing force acting on the cast strip or dummy bar during normal operation.

In order to achieve the above-mentioned object, the present invention provides a cast strip withdrawing apparatus for a continuous casting facility having the following configuration.

According to a first aspect of the present invention, a cast strip withdrawing apparatus for a continuous casting facility includes: a plurality of pairs of rolls disposed along a withdrawing direction of cast strips, a dummy bar being retained and withdrawn by a fixed-side roll and a clamping-side roll, which oppose each other, of each of the plurality of pairs of rolls; a fluid pressure cylinder provided to each of the clamping-side rolls, and imparting a dummy bar retaining pressure; and a source pressure side fluid line that supplies fluid pressure to the fluid pressure cylinder, wherein the source pressure side fluid line includes: a first pressure-reduction means for reducing the dummy bar retaining pressure; a pressure drop detection means for detecting a drop in the dummy bar retaining pressure; a line isolating means installed on a source pressure side of the pressure drop detection means, for isolating a source pressure side fluid line for which a drop in the dummy bar retaining pressure has been detected by way of the pressure drop detection means; and a bypass means for, when a drop in the dummy bar retaining pressure has been detected by way of the pressure drop detection means in any source pressure side fluid line, isolating by way of the line isolating means the source pressure side fluid line for which the drop has been detected, and simultaneously for letting a predetermined dummy bar retaining pressure which does not pass through the first pressure-reduction means to a side of a source pressure side fluid line for which a drop in the dummy bar retaining pressure has not been detected by the pressure drop detection means.

According to such a configuration, a dummy bar retaining force equivalent to during normal operation can be maintained even during a rupture or leakage of a fluid pressure system, and thus the cast strip and dummy bar are not allowed to fall. Meanwhile, since excessive pressing force is not allowed to act on the dummy bar during normal operation, the dummy bar is not damaged. Moreover, the cast strip withdrawing apparatus can be configured using a small number of pairs of rolls, a result of which the fluid pressure system for the clamping-side rolls can also be configured more simply.

According to a second aspect of the present invention, in the cast strip withdrawing apparatus for a continuous casting facility as described in the first aspect, the fixed-side roll and the pressure-side roll may both be drive rolls.

According to such a configuration, the number of stages of rolls can be reduced compared to a case of driving only the rolls on one side among the pair of rolls, and thus the cast strip withdrawing apparatus can be reduced in size overall. As a result, the shortening of the overall length of the dummy bar becomes possible.

According to a third aspect of the present invention, in the cast strip withdrawing apparatus for a continuous casting facility as described in the first aspect, the first pressure-reduction means may include a pressure control valve, the line isolating means may include an electromagnetic changeover valve, and the pressure drop detection means may include a pressure switch.

According to such a configuration, upon the detection of a drop in the dummy bar retaining pressure, the line isolating means more quickly operates, whereby the time lag is minimized.

According to a fourth aspect of the present invention, in the cast strip withdrawing apparatus for a continuous casting facility as described in the first aspect, the bypass means may include a line switching means that can switch the source pressure side fluid line of the fluid pressure cylinder, and a bypass line from the line switching means that bypasses the first pressure-reduction means and is directly connected to the source pressure side fluid line.

According to such a configuration, during a steep pressure drop due to a rupture of the fluid pressure system as well, the time lag until the dummy bar retaining pressure rises is minimized in combination with the above-mentioned third aspect.

According to a fifth aspect of the present invention, in the cast strip withdrawing apparatus for a continuous casting facility as described in the fourth aspect, a second pressure-reduction means may be installed in the bypass line so as to be able to reduce the predetermined dummy bar retaining pressure by switching the source pressure side fluid line by way of the line switching means.

According to such a configuration, the dummy bar retaining pressure can be selectively switched to predetermined pressures set in the first pressure-reduction means and the second pressure-reduction means.

According to a sixth aspect of the present invention, in the cast strip withdrawing apparatus for a continuous casting facility as described in the first aspect, the cast strip withdrawing apparatus may include n pairs of drive rolls, and a pressure reduction rate of the first pressure-reduction means may be set to be substantially equal to $(n-1)/n$.

According to such a configuration, the dummy bar retaining force of the cast strip withdrawing apparatus during normal operation can be made substantially equal to the retaining force of the cast strip withdrawing apparatus composed of two pairs of drive rolls; therefore, the dummy bar and cast strip will not be allowed to fall, even if the fluid pressure system related to the any of the cylinders for clamping ruptures or leaks.

According to a seventh aspect of the present invention, in the cast strip withdrawing apparatus for a continuous casting facility as described in the first aspect, the first pressure-reduction means can set the dummy bar retaining pressure to the range of 0.5 to 3 MPa.

According to such a configuration, the cast strip is not excessively pressed by the clamping rolls, and thus the quality of the cast strip is not harmed. In addition, the vertical distance from the casting mold to the cast strip withdrawing apparatus is shortened; therefore, the dummy bar can be made short.

DESCRIPTION OF THE PREFERRED EMBODIMENTS

Figure 1:
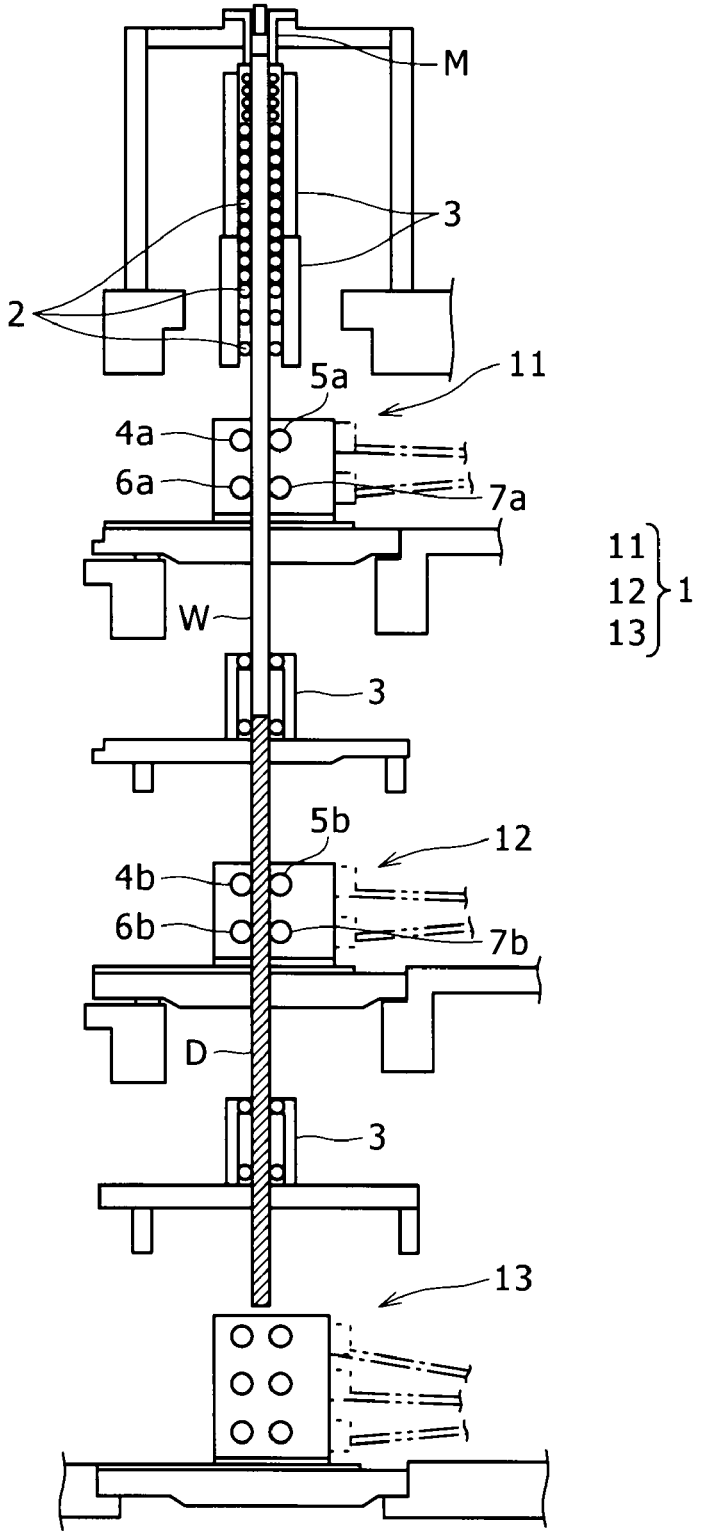
FIG. 1 is a front cross-sectional view showing a state when initiating casting in a continuous casting facility according to a first embodiment of the present invention.
Figure 2:
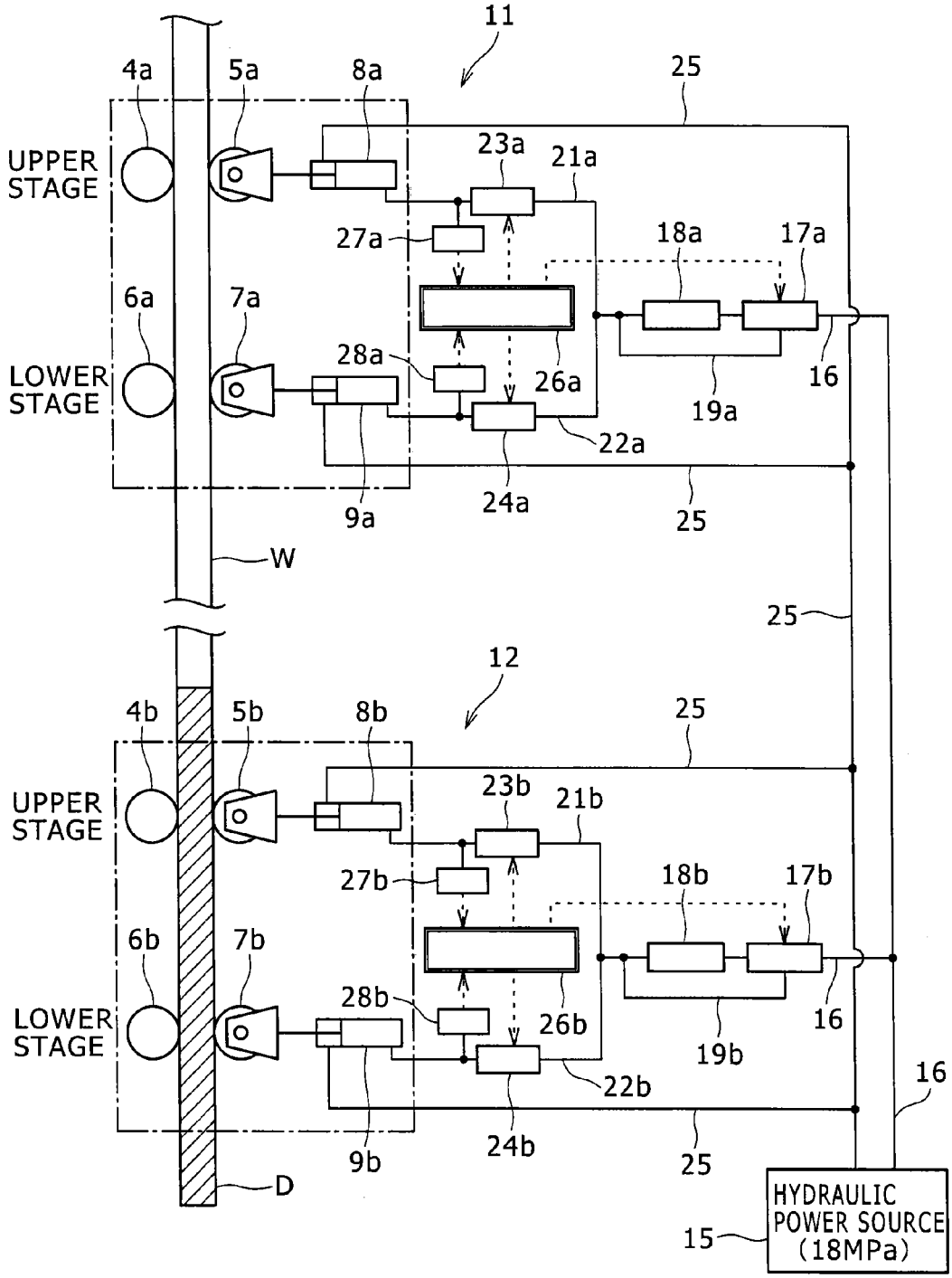
FIG. 2 is a schematic hydraulic system diagram illustrating the hydraulic systems of first and second cast strip withdrawing apparatuses of FIG. 1 and the operating conditions of the hydraulic systems during normal operation.
Figure 3:
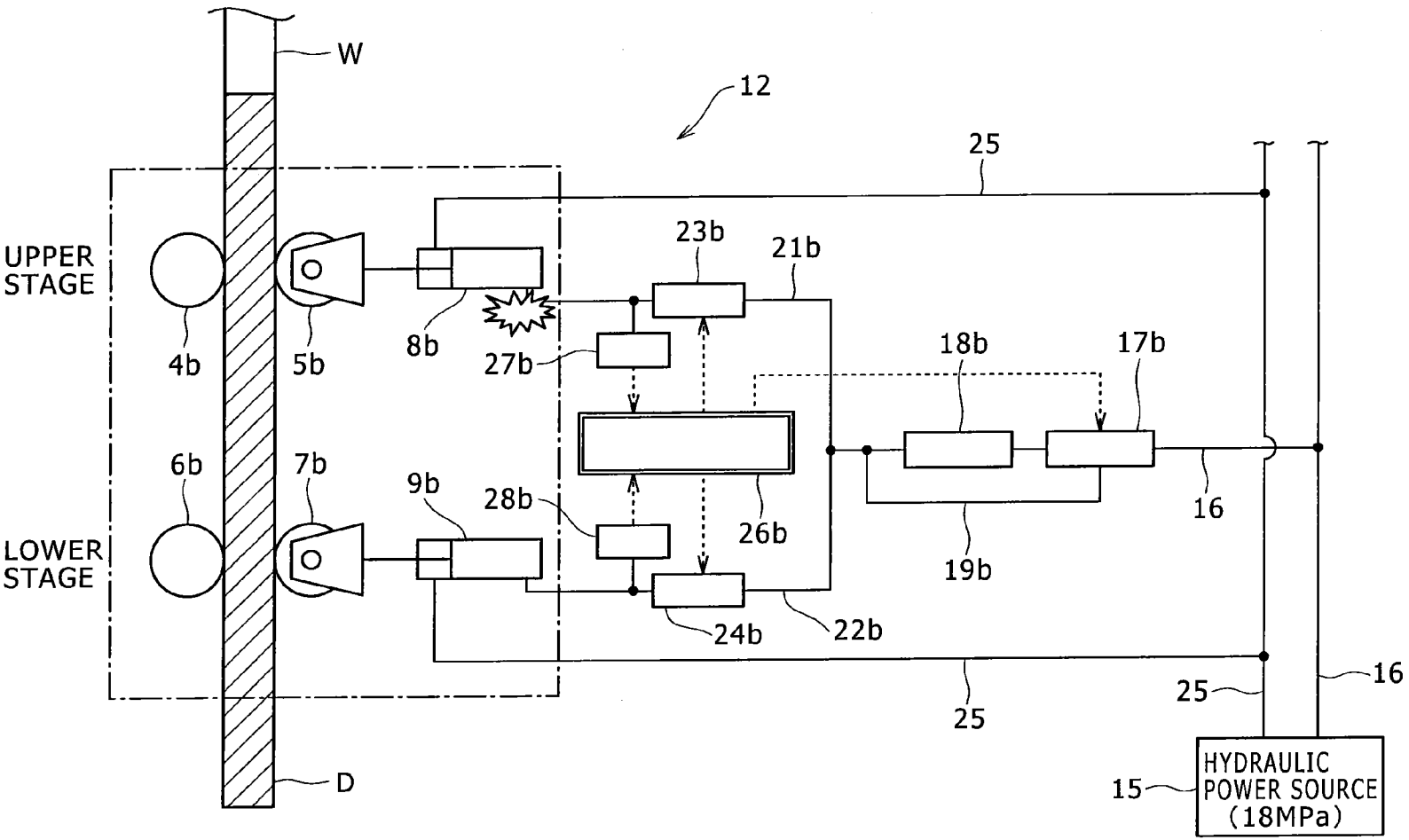
FIG. 3 is a schematic hydraulic system diagram illustrating an operating condition of the second cast strip withdrawing apparatus in FIG. 1 in a case in which an upper-side hydraulic system thereof has ruptured.
Figure 4:
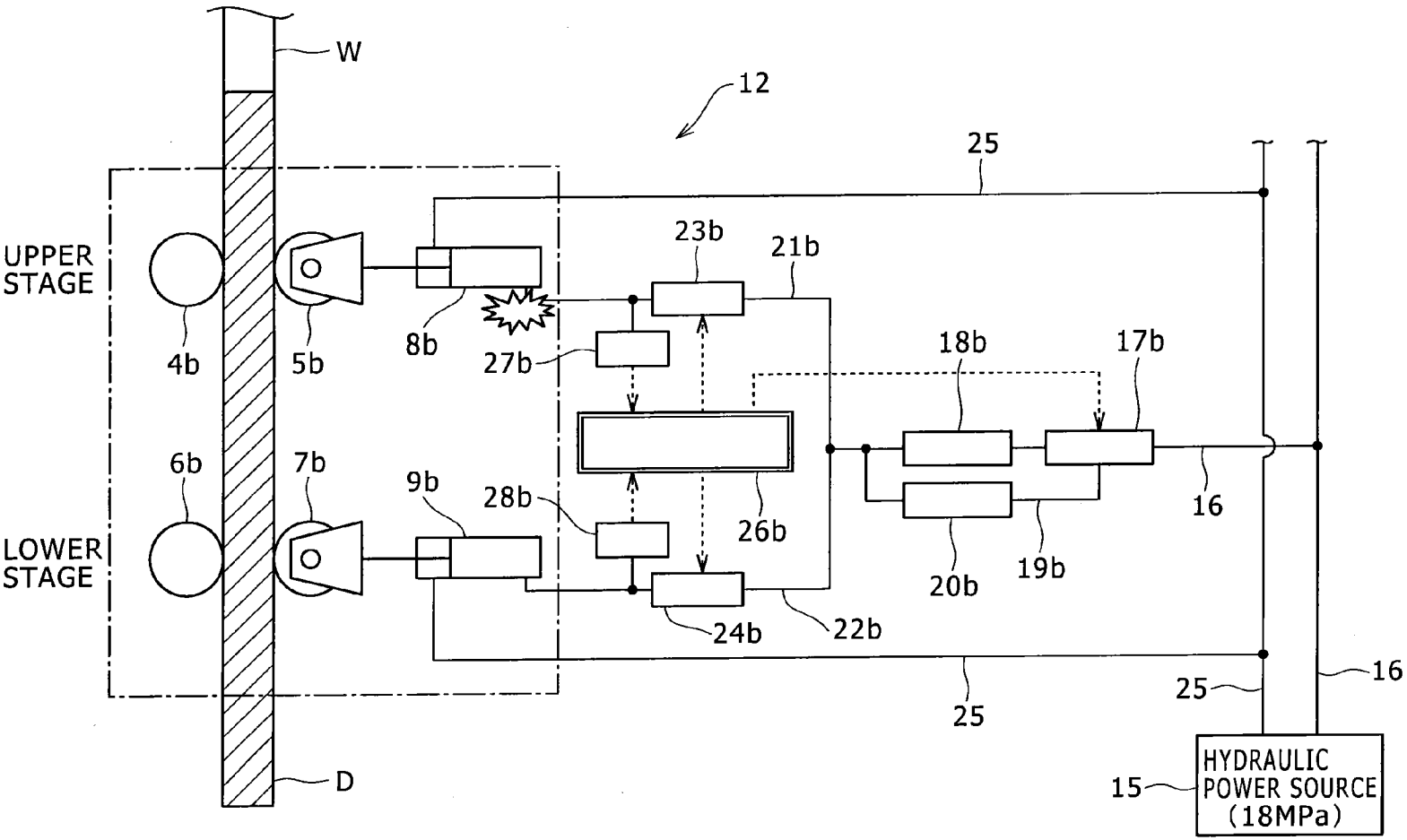
FIG. 4 is a schematic hydraulic system diagram illustrating an operating condition of the second cast strip withdrawing apparatus in FIG. 1 in a case of the upper-stage side hydraulic system according to another example embodiment having ruptured.
Figure 5:
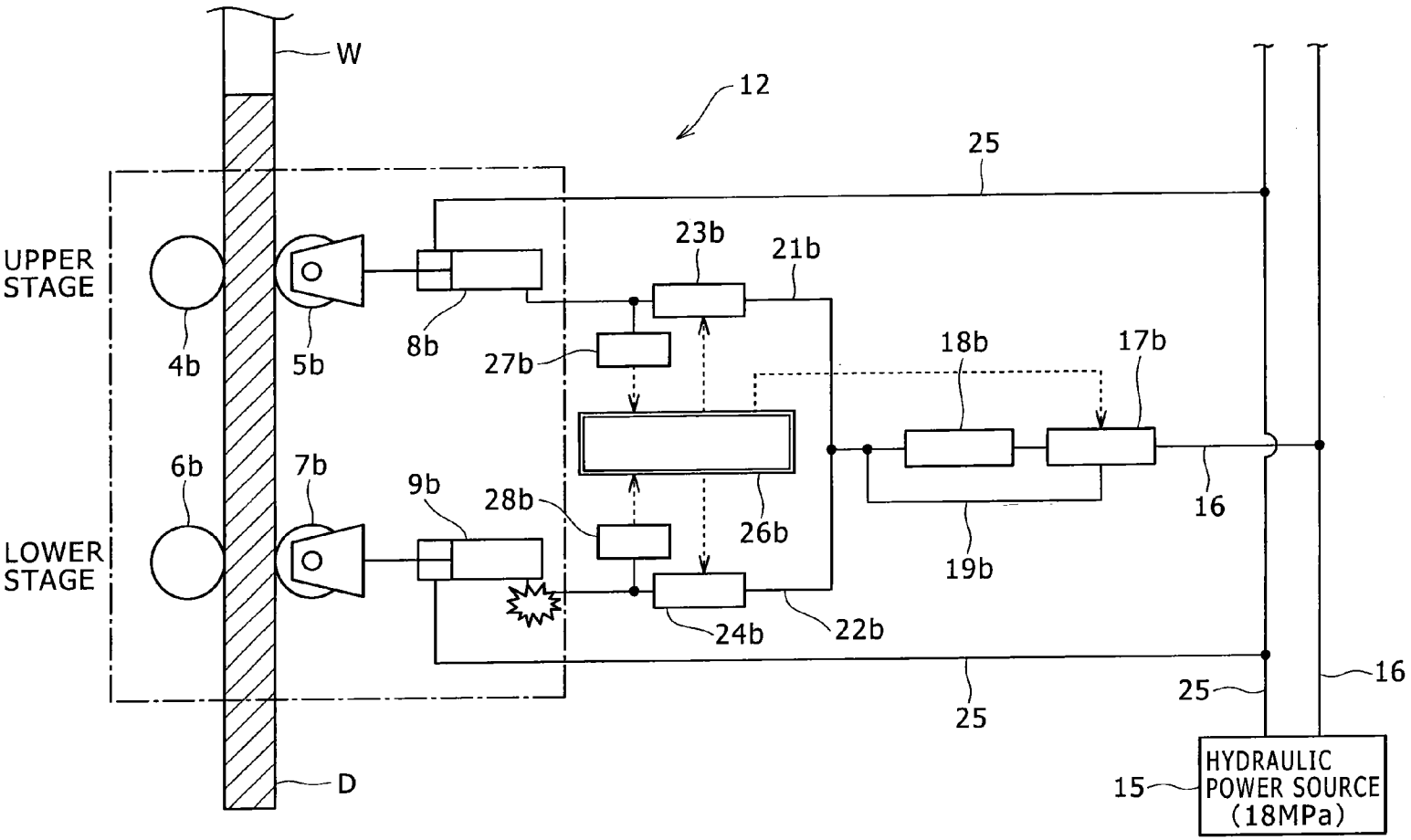
FIG. 5 is a schematic hydraulic system diagram illustrating an operating condition of the second cast strip withdrawing apparatus in FIG. 1 in a case of the lower-stage side hydraulic system having ruptured.

An example embodiment in which a cast strip withdrawing apparatus for a continuous casting facility according to a first embodiment of the present invention and an operating method thereof are applied to a first cast strip withdrawing apparatus and a second cast strip withdrawing apparatus of a vertical continuous casting facility will be explained while referring to the following appended FIGS. 1 to 5. FIG. 1 is a front cross-sectional view showing a state when initiating casting in the continuous casting facility according to the first embodiment of the present invention. FIG. 2 is a schematic hydraulic system diagram illustrating hydraulic systems related to the first and second cast strip withdrawing apparatus in FIG. 1 and operating conditions of the hydraulic system during normal operation. FIG. 3 is a schematic hydraulic system diagram illustrating an operating condition of the second cast strip withdrawing apparatus in FIG. 1 in a case of an upper-stage side hydraulic system having ruptured. FIG. 4 is a schematic hydraulic system diagram illustrating an operating condition of the second cast strip withdrawing apparatus of FIG. 1 in a case of an upper-stage side hydraulic system according to another example embodiment having ruptured. FIG. 5 is a schematic hydraulic system diagram illustrating an operating condition of the second cast strip withdrawing apparatus in FIG. 1 in a case of a lower-stage side hydraulic system having ruptured.

As shown in FIG. 1, in the vertical continuous casting facility according to the first embodiment of the present invention, a plurality of roll segments 3 provided with several support rolls 2 that support a cast strip W casted is disposed below a mold M along a withdrawing direction (casting direction) of the cast strip W, and a cast strip guide device is configured by this plurality of roll segments 3. Then, between these roll segments 3, a plurality of cast strip withdrawing apparatuses 1, i.e. a first cast strip withdrawing apparatus 11, second cast strip withdrawing apparatus 12 and third cast strip withdrawing apparatus 13, are disposed at predetermined intervals in the vertical direction, in order to withdraw the cast strips W along the withdrawing direction.

It is configured such that the cast strips W thus casted are sequentially withdrawn by the first to third cast strip withdrawing apparatuses 11 to 13, while being supported by the support rolls 3. However, at the initial stage of casting in a continuous casting facility, as shown in FIG. 1, ahead of the cast strip W, a dummy bar D is withdrawn sequentially by the first to third cast strip withdrawing apparatuses 11 to 13 while being supported by the support rolls 3.

First, the configuration of these cast strip withdrawing apparatuses 1 will be explained with the first and second cast strip withdrawing apparatuses 11 and 12 as examples, while referring to the FIGS. 1 and 2. Respectively opposing upper-stage rolls 4*a* and 5*a* and lower-stage rolls 6*a* and 7*a* are disposed at the first cast strip withdrawing apparatus 11. The upper-stage rolls 4*a* and 5*a* are composed of a fixed-side drive roll 4*a* and a clamping-side drive roll 5*a*, while the lower-stage rolls 6*a* and 7*a* are also composed of a fixed-side drive roll 6*a* and a clamping-side drive roll 7*a*.

Then, a pressing force is imparted on the clamping-side drive roll 5*a* of the upper stage by way of a hydraulic cylinder (fluid pressure cylinder) 8*a*, while a pressing force is also imparted on the clamping-side drive roll 7*a* of the lower stage by way of a hydraulic cylinder (fluid pressure cylinder) 9*a*, to hold the cast strip W between the fixed-side drive rolls 4*a* and 6*a*, and the clamping-side drive rolls 5*a* and 7*a*, respectively, thereby retaining the cast strip W. Furthermore, similarly to conventional example 1, the fixed-side drive rolls 4*a* and 6*a* and the clamping-side drive rolls 5*a* and 7*a* are configured so as to each be rotationally driven by drive motors via a worm reduction device, a universal spindle and a reduction mechanism that are not illustrated, and withdraw a cast strip W held between the upper-stage rolls 4*a* and 5*a* and the lower-stage rolls 6*a* and 7*a*.

On the other hand, similarly to the first cast strip withdrawing apparatus 11, opposing upper-stage rolls 4*b* and 5*b* and lower-stage rolls 6*b* and 7*b* are each disposed at the second cast strip withdrawing apparatus 12, the upper-stage rolls 4*b* and 5*b* being composed of a fixed-side drive roll 4*b* and clamping-side drive roll 5*b*, and the lower-stage rolls 6*b* and 7*b* being composed of a fixed-side drive roll 6*b* and clamping-side drive roll 7*b*.

Then, a pressing force is imparted on the clamping-side drive rolls 5*b* and 7*b* of the upper stage and lower stage by way of hydraulic cylinders (fluid pressure cylinders) 8*b* and 9*b*, respectively, to hold the dummy bar D between the fixed-side drive rolls 4*b* and 6*b*, and the clamping-side drive rolls 5*b* and 7*b*, respectively, thereby retaining the dummy bar D. Furthermore, the fixed-side drive rolls 4*b* and 6*b* and the clamping-side drive rolls 5*b* and 7*b* are also configured so as to each be rotationally driven by drive motors via a worm reduction device, a universal spindle and a reduction mechanism that are not illustrated, and withdraw the dummy bar D held between the upper-stage rolls 4*b* and 5*b* and the lower-stage rolls 6*b* and 7*b*.

In a case of a vertical continuous casting machine for which the damage due to falling of the cast strip W or dummy bar D is great, it is preferable for both the fixed-side rolls and clamping-side rolls to be drive rolls, as stated above. This is because, when either the fixed side or clamping side is established as free rolls, the retaining force is halved. Although either the fixed side or clamping side can be established as free rolls and the other side established as drive rolls, it becomes necessary to have four pairs of rolls (total of eight rolls) if seeking the same retaining force as a configuration with two pairs of drive rolls (total of four rolls).

Next, the configuration of the hydraulic circuits (fluid pressure circuits) related to the first and second cast strip withdrawing apparatuses 11 and 12, and an operational method during normal operation will be explained hereinafter while referring to FIG. 2. The hydraulic power source (fluid pressure source) 15 of these hydraulic circuits is configured by an oil tank, hydraulic pump, electric motor and the like (not illustrated). After a source pressure line (source pressure side fluid line) 16 connected to the hydraulic power source 15 is branched toward the first and second cast strip withdrawing apparatuses 11 and 12. Line switching means 17*a* and 17*b* and first pressure-reduction means 18*a* and 18*b* are installed in this order in these branched source pressure lines 16 and 16, respectively.

Bypass lines 19*a* and 19*b* bypassing the respective first pressure-reduction means 18*a* and 18*b* and directly connected to the source pressure lines 16 and 16 are connected to the switching side of the line switching means 17*a* and 17*b*, respectively. The bypass means of each of the first and second cast strip withdrawing apparatuses 11 and 12 are configured from the line switching means 17 and 17*b* and the corresponding bypass lines 19*a* and 19*b*. These bypass lines 19*a* and 19*b* are lines that directly supply the source pressure of the hydraulic power source 15 to the hydraulic cylinders 8*a* and 9*a* for the first cast strip withdrawing apparatus 11 and the hydraulic cylinders 8*b* and 9*b* for the second cast strip withdrawing apparatus 12, without reducing the pressure. Then, the line switching means 17*a* and 17*b* are configured to enable switching the source pressure to the bypass lines 19*a* and 19*b*, avoiding the first pressure-reduction means 18*a* and 18*b*, according to a switching signal commanded by respective control units 26*a* and 26*b*.

In place of the bypass lines 19*a* and 19*b* and first pressure-reduction means 18*a* and 18*b* provided with such line switching means 17*a* and 17*b*, "a pressure varying means using a pressure control valve and the like" may be installed in the source pressure lines 16 and 16, respectively. In this case, the operating time from the detection of a pressure drop due to a rupture until a pressure change is somewhat longer than the time described later.

The source pressure lines 16 and 16 branched for the first and second cast strip withdrawing apparatuses 11 and 12 are further branched to upper-stage side source pressure lines 21*a* and 21*b* and lower-stage side source pressure lines 22*a* and 22*b*, respectively. Furthermore, the upper-stage side pressure lines 21*a* and 21*b* are connected to each hydraulic cylinder 8*a* and 8*b* via respective line isolating means 23*a* and 23*b*, while the lower-stage side source pressure line 22*a* and 22*b* are also connected to the hydraulic cylinders 9*a* and 9*b* via respective line isolating means 24*a* and 24*b*.

Therefore, the source pressure side fluid lines on the upper-stage side of the first and second cast strip withdrawing apparatuses 11 and 12 are configured by the source pressure lines 16 and 16 and the upper-stage side source pressure lines 21*a* and 21*b*, respectively. The source pressure side fluid lines on the lower-stage side are configured by the source pressure lines 16 and 16 and the lower-stage side source pressure lines 22*a* and 22*b*, respectively. Then, an oil drain port of each of the hydraulic cylinders 8*a*, 8*b*, 9*a* and 9*b* and the hydraulic power source 15 are connected by return lines 25, respectively.

Here, the line isolating means 23*a* and 23*b* on the upper-stage side have functions of switching the respective upper-stage side source pressure lines 21*a* and 21*b* to open (oil passing state) or closed (oil blocking state); whereas, the line isolating means 24*a* and 24*b* on the lower-stage side are means having functions of switching the lower-stage side source pressure lines 22*a* and 22*b* to open (oil passing state) or closed (oil blocking state), and can employ an on-off valve, cutoff valve, or the like.

Then, pressure drop signals detected by pressure drop detection means 27*a* and 27*b* installed in each of the upper-stage side source pressure lines 21*a* and 21*b* are transmitted to the control units 26*a* and 26*b*, respectively. In a case of the pressure drop signal having been determined by way of a pressure determination means housed in these control units 26*a* and 26*b* to have dropped and fallen below a pressure drop limit set in advance, the line isolating means 23*a* and 23*b* on the upper-stage side are closed, based on close signals transmitted by the control units 26*a* and 26*b*, respectively. It should be noted that the pressure drop signal of the pressure drop detection means 27*a* and 27*b* can also be used as a "close signal to the line isolating means" and "bypass line switching signal" directly (not through the control units 26*a* and 26*b*).

Furthermore, the pressure drop signals detected by the pressure drop detection means 28*a* and 28*b* installed in each of the lower-stage side source pressure lines 22*a* and 22*b* are transmitted to the respective control units 26*a* and 26*b*. The line isolating means 24*a* and 24*b* on the lower-stage side are closed based on the close signals of the respective control units 26*a* and 26*b*, in a case of the pressure drop signal having been determined by way of a pressure determination means of these control units 26*a* and 26*b* to have dropped and fallen below a pressure drop limit. The line switching means 17*a* and 17*b* and the line isolating means 23*a*, 23*b*, 24*a* and 24*b* having such a configuration can also configure such that all or a portion of the operating circuit is configured by only hydraulic circuits, without the control units 26*a* and 26*b*.

In the first and second cast strip withdrawing apparatuses 11 and 12 having the aforementioned configuration, during the normal operation, in order not to impart an excessive pressing force on the cast strip W having a thin solidified shell, the pressurized oil having source pressure of 18 MPa sent from the hydraulic power source 15 is preferably reduced to 0.5 to 3 MPa by the first pressure-reduction means 18*a* and supplied to the hydraulic cylinders 8*a* and 9*a* of the first cast strip withdrawing apparatus 11, for example. Despite having been illustrated by a case of imparting minimal pressing force of an extent that will not harm the quality of the cast strip W, the pressing force may be set to 0 (zero), or the clamping-side rolls 5*a* and 7*a* may be made to completely retract from the cast strip W. Furthermore, the clamping-side rolls 5*a* and 7*a* may be made to retract to a position where they are along the cast strip W. The numerical values appended to each line in FIG. 2 indicate examples of the hydraulic pressure (fluid pressure: MPa) at the positions.

Herein, the means for reducing the pressing force to 0.5 to 3 MPa is not limited to the first pressure-reduction means 18*a*. For example, in a case of equipping a separate pressure-reduction means than the first pressure-reduction means 18*a* and clamping the cast strip W, it is also possible to make a configuration that switches to this "separate pressure-reduction means". On the other hand, in a case of using the first pressure-reduction means 18*a*, the first pressure-reduction means 18*a* may be provided with a function to switch or vary the pressure to establish a relatively high pressure when clamping the dummy bar D, and to a low pressure (0.5 to 3 MPa) when clamping the cast strip W.

In addition, the present embodiment has been explained by giving, as an example, a case in which the dummy bar D is clamped and retained by the second cast strip withdrawing apparatus 12, while the cast strip W is present in the first cast strip withdrawing apparatus 11. Similarly to this, there may be a case in which the dummy bar D is clamped and retained by a third cast strip withdrawing apparatus 13, while the cast strip W is present in the first cast strip withdrawing apparatus 11 or the second cast strip withdrawing apparatus 12. In this case, in the first and second cast strip withdrawing apparatuses 11 and 12, during the normal operation, in order not to impart an excessive pressing force on the cast strip W having a thin solidified shell, the pressurized oil having source pressure of 18 MPa sent from the hydraulic power source 15 is preferably reduced to 0.5 to 3 MPa by the first pressure-reduction means 18*a* and 18*b* and supplied to the hydraulic cylinders 8*a*, 9*a*, 8*b* and 9*b*, for example. In this regard, the pressing force may be set to 0 (zero), and the clamping-side rolls 5*a*, 7*a*, 5*b* and 7*b* may be made to completely retract from the cast strip W. Furthermore, the clamping-side rolls 5*a*, 7*a*, 5*b* and 7*b* may be made to retract to a position where they are along the cast strip W.

On the other hand, in the second cast strip withdrawing apparatus 12, the pressurized oil supplied to the hydraulic cylinders 8*b* and 9*b* is reduced from the 18 MPa source pressure to 9 MPa by the first pressure-reduction means 18*b*, as shown in FIG. 2. In a case of configuring the second cast strip withdrawing apparatus 12 with two pairs of rolls, a hydraulic configuration is preferable in which the pressure reduction rate by the first pressure-reduction means 18*b* is set on the order of approximately ½ (=50%). During normal operation, pressurized oil at a pressure of 9 MPa is supplied to both the hydraulic cylinder 8*b* on the upper-stage side and the hydraulic cylinder 9*b* on the lower-stage side through the first pressure-reduction means 18*b* with a 50% pressure reduction rate.

In the present case of the second cast strip withdrawing apparatus 12, the diameter of the hydraulic cylinders 8*b* and 9*b* on the head side is 440 mm, and the coefficient of friction μ at the contact surfaces between the fixed-side drive rolls 4*b*, 6*b* and clamping-side drive rolls 5*b*, 7*b* and the dummy bar D is 0.1, for example. The retaining force of the second cast strip withdrawing apparatus 12 during normal operation is obtained through the following formula (1). This retaining force corresponds to a value obtained by adding a slight margin (retaining margin) to the weight of the retained articles (dummy bar and cast strip W) of the second cast strip withdrawing apparatus 12.

$$\text{Hydraulic cylinder head surface area} \times 9\ \text{MPa} \times \mu \times 4\ \text{rolls} = \pi \times (440/2)^2 \times 9 \times 0.1 \times 4 = 547 \times 10^3\ \text{N} = 55.8\ \text{tons} \quad (1)$$

Next, an operational method for a case of the upper-stage side source pressure line having ruptured will be explained hereinafter, while referring to FIG. 3, with the second cast strip withdrawing apparatus 12 as an example. Accompanying a rupture of the upper-stage side source pressure line 21*b* (a rupture between the line isolating means 23*b* and hydraulic cylinder 8*b* (including the hydraulic cylinder itself) as shown in FIG. 3), a drop in the supply pressure to the hydraulic cylinder 8*b* is detected by the pressure drop detection means 27*b*, and a pressure drop signal thereof is transmitted to the control unit 26*b*.

When this is done, the target location to be isolated (i.e. line in which a pressure drop occurring due to rupture has been detected) can be specified by this pressure drop signal; therefore, in a case of the pressure drop signal having been determined by way of a pressure determination means housed in this control unit 26*b* to have dropped and fallen below a pressure drop limit set in advance, the line isolating means 23*b* on the upper-stage side that is the source pressure side is closed, based on a close signal transmitted by the control unit 26*b*. As a result, supply of pressurized oil to the hydraulic cylinder 8*b* is instantaneously interrupted to prevent any more leakage from the ruptured part and stop the drop in oil pressure from spreading to other hydraulic lines.

At the same time, a line switching signal is transmitted from the control unit 26*b* to the line switching means 17*b*. When this is done, the line switching means 17*b* supplies the pressurized oil from the source pressure line 16 which does not pass through the first pressure-reduction means 18*b* and is remained at 18 MPa to the hydraulic cylinder 9*b* via the lower-stage side source pressure line 22*b*. Although the retaining force generated by the upper-stage hydraulic cylinder 8*b* in the second cast strip withdrawing apparatus 12 is lost, the retaining force generated by the lower-stage hydraulic cylinder 9*b* during the rupture of the upper-stage side source pressure line 21*b* follows the following formula (2); therefore, the same retaining force as during normal operation (when retaining with two pairs of rolls) can be maintained even during the rupture of the upper-stage side source pressure line 21*b*.

$$\text{Hydraulic cylinder head surface area} \times 18\ \text{MPa} \times \mu \times 2\ \text{rolls} = \pi \times (440/2)^2 \times 18 \times 0.1 \times 2 = 547 \times 10^3\ \text{N} = 55.8\ \text{tons} \quad (2)$$

As an example embodiment in which the fluid pressure supplied to the hydraulic cylinder 9*b* is switchable also to near the source pressure directly, a second pressure-reduction means (pressure control valve) 20*b* may be provided also to the bypass line 19*b*, as shown in FIG. 4. More specifically, an embodiment is considered in which a low pressure line and high pressure line are switched by the line switching means 17*b*, with the set pressure of the second pressure-reduction means 20*b* being set to 17 MPa (high pressure line), while the set pressure of the first pressure-reduction means 18*b* is set to 9 MPa (low pressure line).

In this case, although the pressure of the hydraulic power source 15 of 18 MPa cannot be directly supplied as is to the hydraulic cylinder 9*b*, it has an equivalent function as 17 MPa (high pressure line). In the case of the present example embodiment, the pressure can be freely set so long as being no more than the pressure of the hydraulic power source 15 (18 MPa in the case of the embodiment), and thus a degree of freedom is achieved in the hydraulic cylinder diameter selection. However, since the extra second pressure-reduction means 20*b* is added, the time required in raising the pressure (time lag) lengthens slightly.

In addition, similarly to the third cast strip withdrawing apparatus 13 shown in FIG. 1, in a case of the second cast strip withdrawing apparatus 12 being configured by three pairs of drive rolls, it is preferable to set the pressure reduction rate of a pressure-reduction means that is not illustrated to approximately ⅔ (66%). In this case, due to being configured by three pairs of drive rolls, if the diameter of the hydraulic cylinder on the head side is set to approximately 310 mm, a retaining force that is substantially the same as the case of being configured by two pairs of drive rolls can be maintained. Even in this case, the retaining force during normal operation is obtained according to the following formula (3), and the retaining force of the second cast strip withdrawing apparatus 12 is substantially the same as the retaining force of the second cast strip withdrawing apparatus 12 obtained from the previous formula (1).

$$\text{Hydraulic cylinder head surface area} \times 18\ \text{MPa} \times (2/3) \times \mu \times 6\ \text{rolls} = \pi \times (310/2)^2 \times 12 \times 0.1 \times 6 = 543 \times 10^3\ \text{N} = 55.4\ \text{tons} \quad (3)$$

Herein, the upper-stage side is assumed to have ruptured. The retaining forces of central-stage and lower-stage hydraulic cylinders during the rupture of the upper-stage side source pressure line follows the following formula (4); therefore, a retaining force equivalent to that during normal operation (when retaining with three pairs of rolls) can be maintained also during the rupture of the upper-stage side source pressure line.

$$\text{Hydraulic cylinder head surface area} \times 18\ \text{MPa} \times \mu \times 4\ \text{rolls} = \pi \times (310/2)^2 \times 18 \times 0.1 \times 4 = 543 \times 10^3\ \text{N} = 55.4\ \text{tons} \quad (4)$$

Furthermore, in the case of a cast strip withdrawing apparatus configured by n pairs of drive rolls, it is preferable for the pressure reduction rate of the first pressure-reduction means, which is not illustrated, to be approximately (n−1)/n. If the hydraulic cylinder head surface area is assumed to be A, the retaining force during normal operation is obtained by the following formula (5).

$$A\times 18\ \text{MPa}\times\{(n-1)/n\}\times\mu\times n\ \text{pairs}\times 2\ \text{rolls}=A\times 18\ \text{MPa}\times 2(n-1)\times\mu \quad (5)$$

Here, the source pressure line of any one pair among the n pairs of roll pairs is assumed to have ruptured. The retaining force of the hydraulic cylinders of the (n−1) pairs that have not ruptured follows the following formula (6); therefore, it is possible to maintain a retaining force equivalent to that during normal operation (when retaining with n pairs of rolls) even if the source pressure line of any one pair among the n pairs has ruptured.

$$A\times 18\ \text{MPa}\times\mu\times(n-1)\text{pairs}\times 2\ \text{rolls}=A\times 18\ \text{MPa}\times 2(n-1)\times\mu \quad (6)$$

The operating condition in a case of the lower-stage side source pressure line 22*b* having ruptured will also be explained hereinafter while referring to FIG. 5, similarly with the second cast strip withdrawing apparatus 12 as an example. Accompanying the rupture of the lower-stage side source pressure line 22*b*, the drop in supply pressure to the hydraulic cylinder 9*b* is detected by the pressure drop detection means 28*b*, and a pressure drop signal thereof is transmitted to the control unit 26*b*. When this is done, in a case of the pressure drop signal having been determined by way of a pressure determination means housed in this control unit 26*b* to have dropped and fallen below a pressure drop limit set in advance, the line isolating means 24*b* on the lower-stage side is closed, based on a close signal transmitted by the control unit 26*b*. As a result, supply of pressurized oil to the hydraulic cylinder 9*b* is instantaneously interrupted to prevent any more leakage from the ruptured part and stop the drop in oil pressure from spreading to other hydraulic lines.

At the same time, when a line switching signal is transmitted from the control unit 26*b* to the line switching means 17*b*, the line switching means 17*b* supplies the pressurized oil from the source pressure line 16 which does not pass through the first pressure-reduction means 18*b* and is remained at 18 MPa to the hydraulic cylinder 8*b* via the upper-stage side source pressure line 21*b*. Although the retaining force of the lower-stage hydraulic cylinder 9*b* in the second cast strip withdrawing apparatus 12 is lost, the retaining force of the upper-stage side hydraulic cylinder 8*b* during the rupture of the lower-stage side source pressure line 22*b* also identically follows the previous formula (2); therefore, the retaining force equivalent to that during normal operation (when retaining with two pairs of rolls) can be maintained even during the rupture of the lower-stage side source pressure line 22*b*.

It should be noted that the line switching means 17*a* and 17*b* are preferably configured using electromagnetic changeover valves. The first pressure-reduction means 18*a* and 18*b* are preferably configured using pressure controls valves. The line isolating means 23*a*, 23*b*, 24*a* and 24*b* are preferably configured using electromagnetic cutoff valves. The pressure drop detection means 27*a*, 27*b*, 28*a* and 28*b* are preferably configured using pressure switches. By establishing such a configuration, a pressure drop is detectable after 0.04 sec from rupture occurrence, a closing operation of the line isolating means 23*a*, 23*b*, 24*a* and 24*b* and a switching operation of the line switching means 17*a* and 17*b* are performed, and line isolation and pressure rise are completed after 0.18 sec from rupture occurrence; therefore, the retained article will not fall from the cast strip withdrawing apparatus 1.

Although a rupture in a hydraulic line may also occur in the first cast strip withdrawing apparatus 11 retaining the cast strip W, the cast strip W will not fall since it is also retained by the second cast strip withdrawing apparatus 12 at a downstream side via the dummy bar D. In addition, although rupturing of the upper-stage side and lower-stage side source pressure lines 21*b* and 22*b* of the second cast strip withdrawing apparatus 12 has been used as examples for the aforementioned explanation, similarly to this, there may be rupturing in the first cast strip withdrawing apparatus 11 when in a state clamping and retaining the dummy bar D with the first cast strip withdrawing apparatus 11. In this case as well, the necessary retaining force can be maintained by a method according to the same technical concept as the above explanation. Furthermore, although there may be a case of rupturing in the third cast strip withdrawing apparatus 13 when in a state clamping and retaining the dummy bar D with the third cast strip withdrawing apparatus 13, in this case, the retaining force can be maintained by the operational method of the cast strip withdrawing apparatus according to the sixth aspect of the present invention.

The first and second cast strip withdrawing apparatuses 11 and 12 according to the first embodiment of the present invention are configured by the two pairs of rolls of the upper and lower stages, and hydraulic cylinders are equipped to each pair of rolls of the upper and lower stage, respectively. A case in which respective the hydraulic lines of the upper stage and lower stage rupture (or leak) at the same time is extremely rare, and thus safe operation is possible.

In order to ensure more safety, it has been consider to provide an independent hydraulic system to every pair of rolls so that a rupture at one location in a hydraulic line does not affect other hydraulic lines; however, if the required retaining force is to be maintained even if one among the hydraulic lines connected to the two hydraulic cylinders ruptures (or leaks), it must be made to operate at a clamping force twice the required clamping force, and thus an excessive pressing force will act on the retained article. The dummy bar D will receive damage such as permanent strain due to the ordinarily strong pressing force. Furthermore, the roll diameter and bearings pivotally supporting the rolls become large, and the frame configuring the first and second cast strip withdrawing apparatuses 11 and 12 also become large. According to the first and second cast strip withdrawing apparatuses 11 and 12 according to the present invention, normal operation can be performed at the required clamping force, and the clamping force temporarily increases only during a hydraulic line rupture; therefore, the dummy bar D will not be damaged.

In the cast strip withdrawing apparatus according to the related art, even if any among the hydraulic lines connected to the hydraulic cylinders rupture, at least one pair of additional rolls is necessary in the cast strip withdrawing apparatus if the required retaining force is to be maintained. As a result, the cast strip withdrawing apparatus increases in size and a hydraulic system and roll driving system for the pair of additional rolls are necessary. According to the cast strip withdrawing apparatus for a continuous casting facility according to the present invention, even if rupturing or leakage occurs, the required retaining force can be maintained by the roll configuration composed of a small number of rolls and the hydraulic circuit configuration composed of a few systems.

With a vertical continuous casting facility, that is, a system of inserting the dummy bar D from below, is widely employed. In this case, according to the cast strip withdrawing apparatus 1, the dummy bar D is led to the casting mold M by handing over the dummy bar D to an upstream side in sequence from the third cast strip withdrawing apparatus 13, second cast strip withdrawing apparatus 12 to the first cast strip withdrawing apparatus 11. The first and second cast strip withdrawing apparatuses 11 and 12 are equipped in order to shorten the overall length of the dummy bar D. If the first and second cast strip withdrawing apparatuses 11 and 12 are not equipped, the overall length of the dummy bar D becomes the length from the casting mold M to the third cast strip withdrawing apparatus 13, and thus is not realistic.

Although a state is shown in FIG. 1 in which the dummy bar D and cast strip W following the dummy bar D are retained by the cast strip withdrawing apparatus 1, only the dummy bar D is retained when inserting the dummy bar D from below. In a case of a system of inserting the dummy bar D from below, the clamping frequency by the cast strip withdrawing apparatus 1 increases, and compared to a system inserting the dummy bar D from above, the clamping frequency becomes double.

Additionally, since the dummy bar D is handed over to the upstream side in sequence from the third cast strip withdrawing apparatus 13, second cast strip withdrawing apparatus 12 to the first cast strip withdrawing apparatus 11, the clamping frequency becomes triple. In this way, in the vertical continuous casting facility, the frequency of clamping the dummy bar D by the drive rolls of the cast strip withdrawing apparatus 1 increases, and the dummy bar D and drive rolls tend to be damaged. In such a situation, the cast strip withdrawing apparatus of the continuous casting facility according to the present invention can perform normal operation at the required clamping force, and the clamping force temporarily increases only during a hydraulic line rupture, and thus is effective without damaging the dummy bar D.

Figure 6:
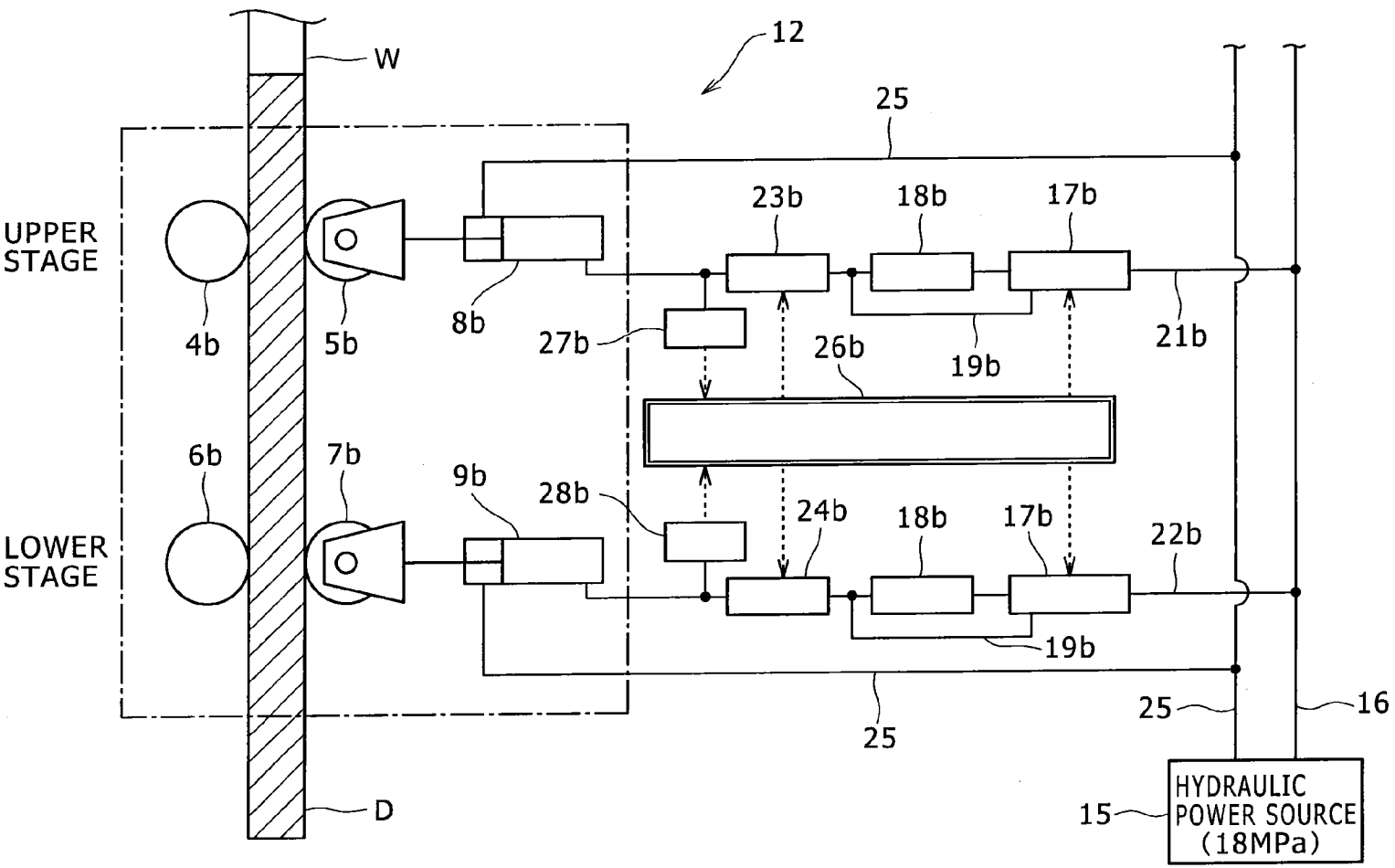
FIG. 6 is a schematic hydraulic system diagram illustrating an operating condition of the hydraulic system of the second cast strip withdrawing apparatus according to a second embodiment of the present invention during normal operation.
Figure 7:
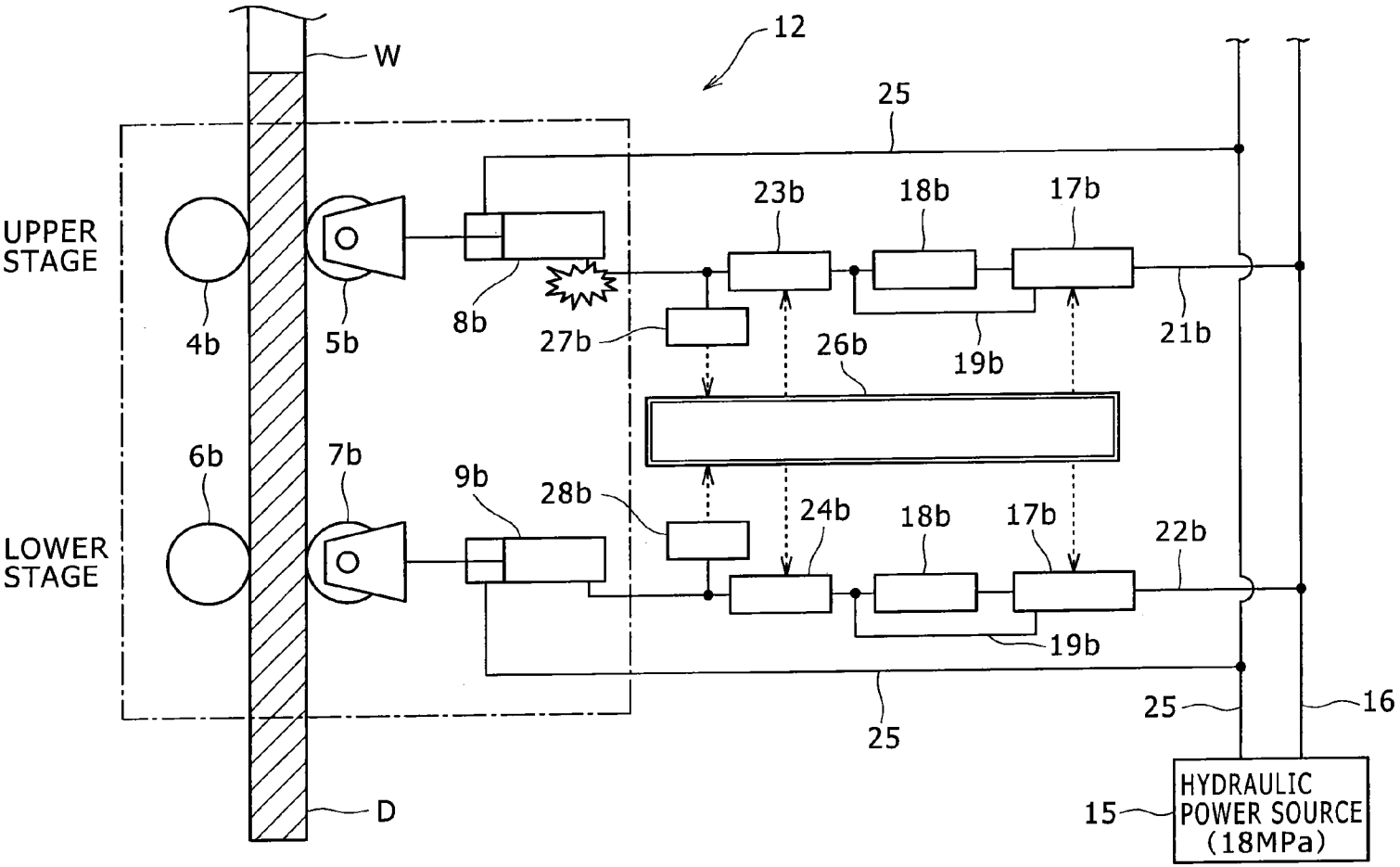
FIG. 7 is a schematic hydraulic system diagram illustrating an operating condition of the second cast strip withdrawing apparatus according to the second embodiment of the present invention in a case of the upper-stage side hydraulic system having ruptured.
Figure 8:
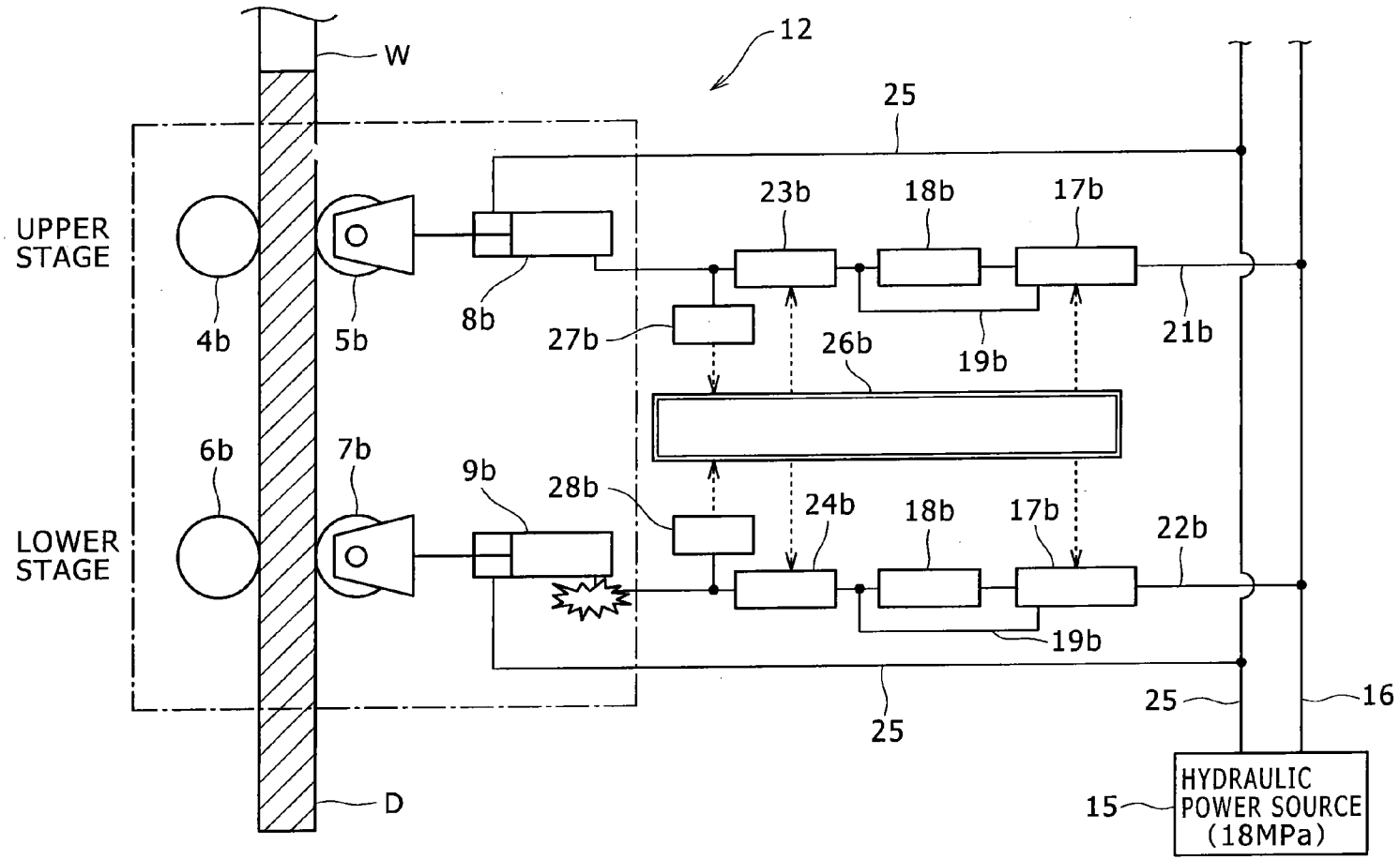
FIG. 8 is a schematic hydraulic system diagram illustrating an operating condition of the second cast strip withdrawing apparatus according to the second embodiment of the present invention in a case of the lower-stage side hydraulic system having ruptured.
Figure 9:
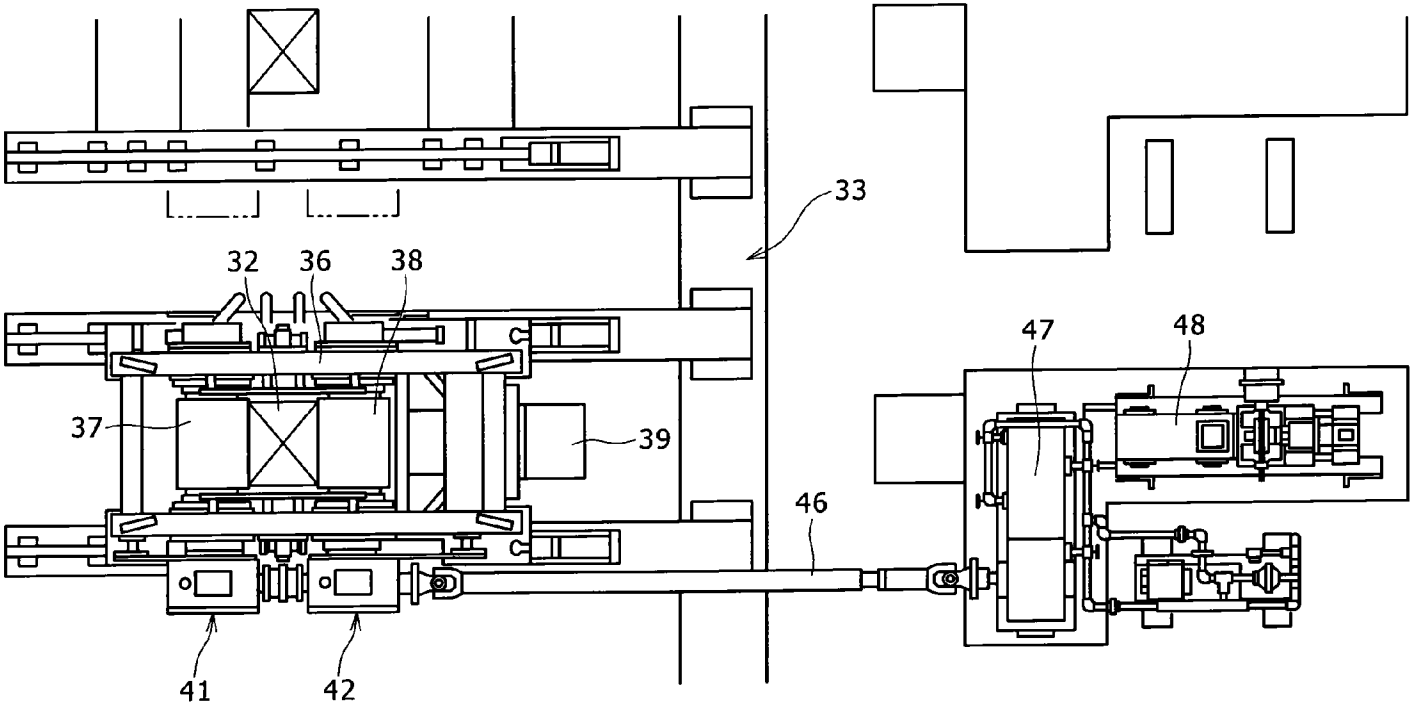
FIG. 9 RELATED ART
FIG. 9 is a plan view showing a cast strip withdrawing apparatus for a continuous casting facility according to a conventional example 1.
Figure 10:
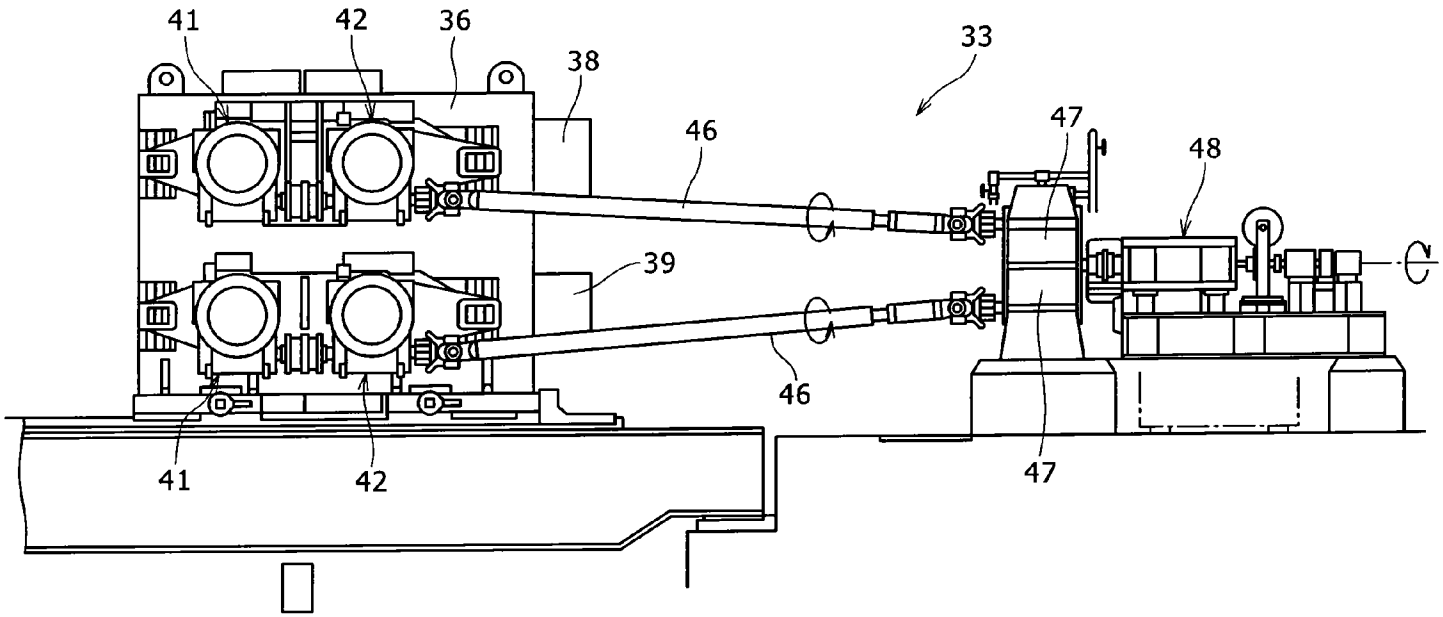
FIG.10 RELATED ART
FIG. 10 is a front view showing the cast strip withdrawing apparatus of FIG. 9.
Figure 11:
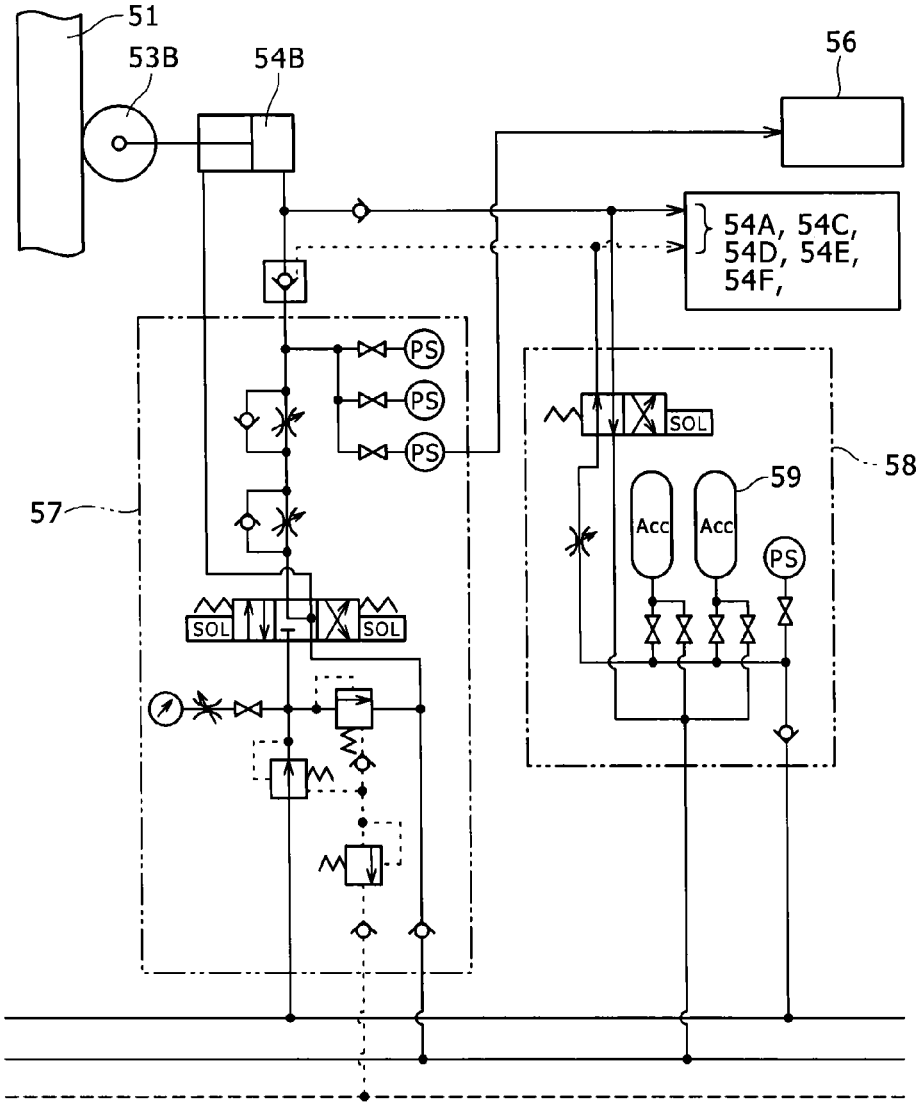
FIG.11 RELATED ART
FIG. 11 is a hydraulic circuit illustrative drawing including an emergency hydraulic valve of a cast strip anti-drop device for a continuous casting machine according to a conventional example 2.
Figure 12:
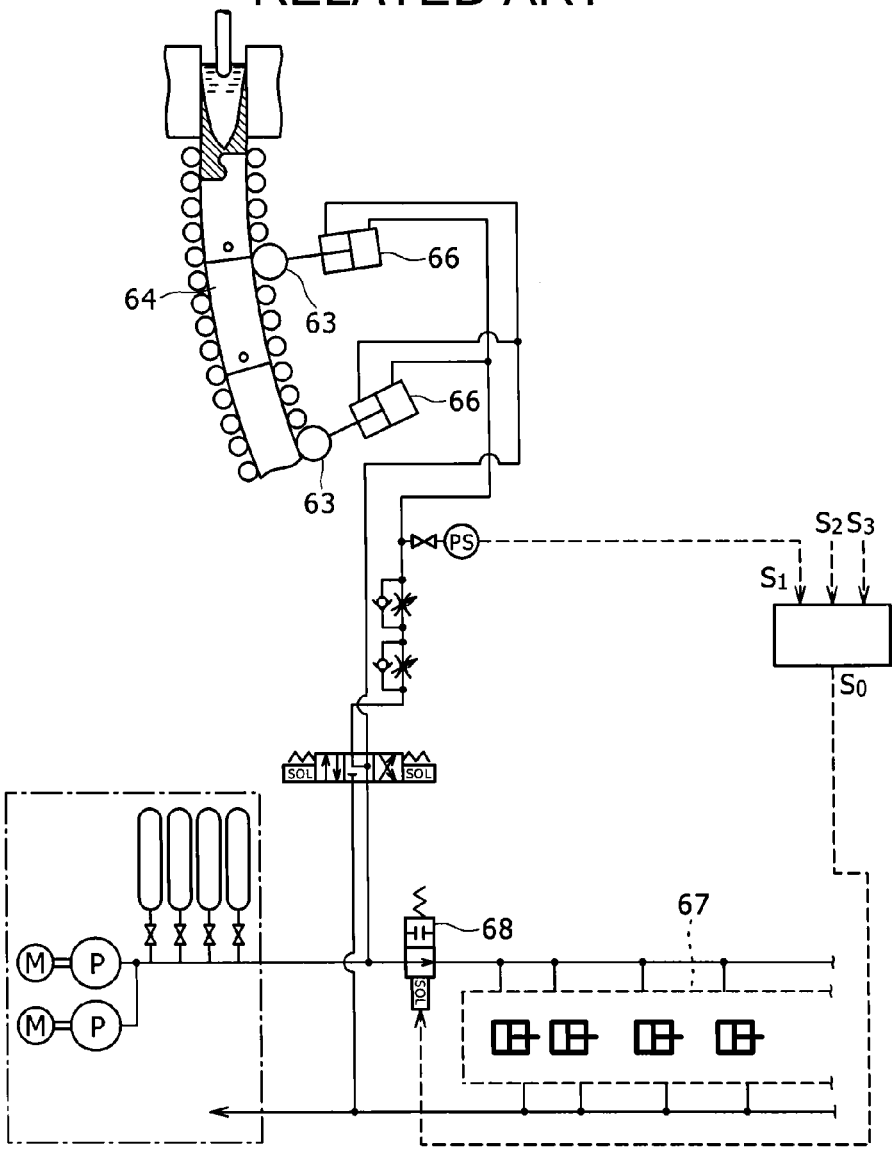
FIG. 12 RELATED ART
FIG. 12 is a schematic diagram showing an example of a cast strip and dummy bar anti-drop hydraulic circuit for a continuous casting machine according to a conventional example 3.

Next, a cast strip withdrawing apparatus for a continuous casting facility and an operational method thereof according to a second embodiment of the present invention will be explained hereinafter while referring to the appended FIGS. 6 to 8, with the example embodiment of the second cast strip withdrawing apparatus. FIG. 6 is a schematic hydraulic system diagram illustrating the operating conditions of the hydraulic system during normal operation of the second cast strip withdrawing apparatus, according to the second embodiment of the present invention. FIG. 7 is a schematic hydraulic system diagram illustrating the operating conditions of the second cast strip withdrawing apparatus according to the second embodiment of the present invention in a case of the upper-stage side hydraulic system thereof having ruptured. FIG. 8 is a schematic hydraulic system diagram illustrating the operating conditions of the second cast strip withdrawing apparatus according to the second embodiment of the present invention in a case of the lower-stage side hydraulic system thereof having ruptured.

However, regarding parts in which the second embodiment of the present invention differs from the above-mentioned first embodiment, there are differences in the arrangement of the hydraulic circuit as far as the hydraulic cylinder of the cast strip withdrawing apparatus and the arrangement of the line switching means, bypass line, first pressure-reduction means and line isolating means installed in this hydraulic circuit, and everything other than this is entirely the same as the aforementioned first embodiment; therefore the same reference symbols are assigned to the same items as in the aforementioned first embodiment, and the differing points thereof will be explained.

The line isolating means 23*b* has an object of "instantaneously interrupting supply of pressurized oil to the hydraulic cylinder 8*b* to prevent any more leakage from the ruptured part and stop the drop in oil pressure from spreading to other hydraulic lines"; therefore, in the case of the circuit configuration of FIG. 6, the line isolating means 23*b* can also be installed on the right side in the illustration of the line switching means 17*b*, for example. In addition, this line isolating means 23*b* can be installed between the first pressure-reduction means 18*b* and line switching means 17*b*, and can also be installed in the bypass line 19*b* as well. It should be noted that this similarly applies for the line isolating means 24*b* as well.

On the other hand, with the circuit configuration of FIG. 3, the line isolating means 23*b* may be installed anywhere between a branching point of the upper-stage side source pressure line 21*b* and lower-stage side source pressure line 22*b*, and the hydraulic cylinder 8*b*.

However, in the case of either circuit configuration of FIG. 3 or FIG. 6, if the line isolating means 23*b* is equipped too close to the hydraulic cylinder 8*b*, it will be effective for a rupture between the line isolating means 23*b* and the hydraulic cylinder 8*b*, but it will not be able to handle a rupture between the line isolating means 23*b* and the hydraulic power source 15. Thus, it is preferable to install the line isolating means 23*b* in the valve stand configuring the pressure-reduction means 18*b*, bypass means 17*b*, 19*b* and the like. It should be noted that, depending on the layout, this valve stand is normally installed at a location separated from several meters to 20 meters from the roll stand.

In other words, in the hydraulic circuit of the second cast strip withdrawing apparatus according to the above-mentioned first embodiment, after the source pressure line 16 connected to the hydraulic power source 15 first branches for the second cast strip withdrawing apparatus 12, the line switching means 17*b* and first pressure-reduction means 18*b* are installed in this branched source pressure line 16. Then, the bypass line 19*b* bypassing the first pressure-reduction means 18*b* and directly connected to the source pressure line 16 is connected to the switching side of the line switching means 17*b*, while this source pressure line 16 is further branched to the upper-stage side source pressure line 21*b* and lower-stage side source pressure line 22*b*, is connected to the hydraulic cylinder 8*b* on the upper-stage side via the line isolating means 23*b* as well as being connected to the hydraulic cylinder 9*b* on the lower-stage side via the line isolating means 24*b*.

In contrast, in the hydraulic circuit of the second cast strip withdrawing apparatus according to the second embodiment, the source pressure line 16 connected to the hydraulic power source 15 is directly branched to the upper-stage side source pressure line 21*b* connected to the upper-stage hydraulic cylinder 8*b* of the second cast strip withdrawing apparatus 12, and to the lower-stage side source pressure line 22*b* connected to the lower-stage hydraulic cylinder 9*b*. Then, the line switching means 17*b* and 17*b*, first pressure-reduction means 18*b* and 18*b*, and line isolating means 23*b* and 24*b* are installed sequentially from a high pressure side in the upper-stage side source pressure line 21*b* and lower-stage side source pressure line 22*b*, respectively.

In addition, the bypass lines 19*b* and 19*b* bypassing the first pressure-reduction means 18*b* and 18*b* and directly connected to the each of the upper- and lower-stage side source pressure lines 21*b* and 22*b* connect between the switching side of each of the line switching means 17*b* and 17*b* and the high pressure side of the line isolating means 23*b* and 24*b*, respectively. Furthermore, the pressure drop detection means 27*b* is attached to the low pressure side of the line isolating means 23*b* of the upper-stage side source pressure line 21*b*, and the pressure drop detection means 28*b* is attached to the low pressure side of the line isolating means 24*b* of the lower-stage side source pressure line 22*b*.

Although the explanation of the operating conditions of the hydraulic system of the second cast strip withdrawing apparatus 12 during normal operation is omitted, they are the same as in the first embodiment explained referring to FIG. 2, as shown in FIG. 6. In addition, the operating conditions in a case of the upper-stage side hydraulic system having ruptured are the same as in the first embodiment explained referring to FIG. 3, as shown in FIG. 7. The operating conditions in a case of the lower-stage side hydraulic system having ruptured are the same as in the first embodiment explained referring to FIG. 5, as shown in FIG. 8.

Therefore, the cast strip withdrawing apparatus for a continuous casting facility according to the second embodiment of the present invention has functional effects similar to the cast strip withdrawing apparatus for a continuous casting facility according to the aforementioned first embodiment of the present invention.

As explained in the foregoing, according to the cast strip withdrawing apparatus for a continuous casting facility according to the present invention, during a rupture or leakage of a hydraulic system, a drop in the oil pressure is instantaneously prevented from affecting other hydraulic systems so that the cast strip or dummy bar are not allowed to fall, while excessive pressing force is not allowed to act on the dummy bar during normal operation; therefore, the dummy bar is not damaged. In addition, the cast strip withdrawing apparatus can be configured using a small number of pairs of rolls, a result of which the fluid pressure system for the clamping-side rolls can also be configured more simply.

According to the operational method of the cast strip withdrawing apparatus for a continuous casting facility according to the present invention, in an operational method of a cast strip withdrawing apparatus configured by n pairs of driver rolls, operation is carried out while the dummy bar retaining force of the cast strip withdrawing apparatus during normal operation is made substantially equal to the retaining force of the cast strip withdrawing apparatus composed of two pairs of drive rolls by setting the pressure reduction rate of the first pressure-reduction means to approximately (n−1)/n; therefore, the dummy bar and cast strip will not be allowed to fall, even if the fluid pressure system related to the any of the cylinders for clamping ruptures or leaks.

What is claimed is:

1. A cast strip withdrawing apparatus for a continuous casting facility, comprising:

a plurality of pairs of rolls disposed along a withdrawing direction of cast strips, a dummy bar being retained and withdrawn by a fixed-side roll and a clamping-side roll, which oppose each other, of each of said plurality of pairs of rolls;

a fluid pressure cylinder provided to each of said clamping-side rolls, and imparting a dummy bar retaining pressure; and a source pressure side fluid line that supplies fluid pressure to said fluid pressure cylinder, wherein said source pressure side fluid line includes:

a first pressure-reduction means for reducing the dummy bar retaining pressure;

a pressure drop detection means for detecting a drop in the dummy bar retaining pressure;

a line isolating means installed on a source pressure side of said pressure drop detection means, for isolating a source pressure side fluid line for which a drop in the dummy bar retaining pressure has been detected by way of said pressure drop detection means; and a bypass means for, when a drop in the dummy bar retaining pressure has been detected by way of said pressure drop detection means in any source pressure side fluid line, isolating by way of said line isolating means said source pressure side fluid line for which the drop has been detected, and simultaneously for letting a predetermined dummy bar retaining pressure which does not pass through said first pressure-reduction means to a side of a source pressure side fluid line for which a drop in the dummy bar retaining pressure has not been detected by said pressure drop detection means.

2. The cast strip withdrawing apparatus for a continuous casting facility according to claim 1, wherein said fixed-side roll and said pressure-side roll are both drive rolls.

3. The cast strip withdrawing apparatus for a continuous casting facility according to claim 1, wherein said first pressure-reduction means includes a pressure control valve, said line isolating means includes an electromagnetic changeover valve, and said pressure drop detection means includes a pressure switch.

4. The cast strip withdrawing apparatus for a continuous casting facility according to claim 1, wherein said bypass means includes a line switching means that can switch said source pressure side fluid line of said fluid pressure cylinder, and a bypass line from said line switching means that bypasses said first pressure-reduction means and is directly connected to said source pressure side fluid line.

5. The cast strip withdrawing apparatus for a continuous casting facility according to claim 4, wherein a second pressure-reduction means is installed in said bypass line so as to be able to reduce the predetermined dummy bar retaining pressure by switching said source pressure side fluid line by way of said line switching means.

6. The cast strip withdrawing apparatus for a continuous casting facility according to claim 1, wherein said cast strip withdrawing apparatus includes n pairs of drive rolls, and a pressure reduction rate of said first pressure-reduction means is set to be substantially equal to (n−1)/n.

7. The cast strip withdrawing apparatus for a continuous casting facility according to claim 1, wherein said first pressure-reduction means can set the dummy bar retaining pressure to the range of 0.5 to 3 MPa.

* * * * *